US008384509B2

(12) United States Patent
Buettner et al.

(10) Patent No.: US 8,384,509 B2
(45) Date of Patent: Feb. 26, 2013

(54) HOLDER FOR FUSES

(75) Inventors: Alex Buettner, Rodental (DE); Frank Leistner, Roedental (DE)

(73) Assignee: Woehner GmbH & Co., KG Elektrotechnische Systeme, Roedental (DE)

( * ) Notice: Subject to any disclaimer, the term of this patent is extended or adjusted under 35 U.S.C. 154(b) by 228 days.

(21) Appl. No.: 12/758,316

(22) Filed: Apr. 12, 2010

(65) Prior Publication Data

US 2010/0259355 A1 Oct. 14, 2010

(30) Foreign Application Priority Data

Apr. 14, 2009 (DE) ..... 10 2009 017 338

(51) Int. Cl.
*H01H 85/54* (2006.01)
*H01H 71/52* (2006.01)

(52) U.S. Cl. ..... 337/143; 337/4; 337/5; 337/89; 337/142; 337/187; 337/194; 337/196; 337/205; 337/211; 361/626; 361/837

(58) Field of Classification Search ..... 337/194, 337/196, 205, 211, 187, 4, 5, 8, 9, 142, 143; 361/642, 626, 646, 837; 439/157, 620.26, 439/620.29, 620.34, 893, 620.3
See application file for complete search history.

(56) References Cited

U.S. PATENT DOCUMENTS

| | | | | | |
|---|---|---|---|---|---|
| 1,966,716 | A | * | 7/1934 | Green | 337/194 |
| 2,072,729 | A | * | 3/1937 | Corbett | 337/196 |
| 2,186,813 | A | * | 1/1940 | Adam et al. | 337/210 |
| 2,289,122 | A | * | 7/1942 | Jackson et al. | 337/188 |
| 3,030,474 | A | * | 4/1962 | Scott, Jr. | 337/7 |
| 3,202,788 | A | * | 8/1965 | George | 337/194 |
| 3,358,100 | A | * | 12/1967 | Schleicher | 337/194 |
| 3,379,842 | A | * | 4/1968 | Downs et al. | 337/146 |
| 4,559,504 | A | | 12/1985 | Krec | 337/194 |
| 4,778,959 | A | * | 10/1988 | Sabatella et al. | 218/1 |
| 4,851,963 | A | * | 7/1989 | Miller et al. | 361/643 |

(Continued)

FOREIGN PATENT DOCUMENTS

| | | |
|---|---|---|
| AT | 177 460 | 2/1954 |
| DE | 890 380 | 9/1953 |

(Continued)

OTHER PUBLICATIONS

The Extended European Search Report from related application Serial No. 10158291.4, dated Aug. 4, 2010.

*Primary Examiner* — Anatoly Vortman
(74) *Attorney, Agent, or Firm* — Westman, Champlin & Kelly, P.A.

(57) ABSTRACT

The invention relates to holders for receiving fuses, with a housing having a receiving shaft, the receiving shaft containing contacts which are provided for contacting at least one fuse inserted into the receiving shaft, a cover which is adjustably arranged in the receiving shaft, a fuse holding device which is adjustably guided in the receiving shaft, wherein the cover has a unit being engageable with a guiding mechanism and which holds the cover at a predetermined position within the housing, a coupling device for detachably coupling the cover to the fuse holding device, wherein the unit of the cover is formed by feet which protrude laterally from the cover and are engageable with the guides in the housing, and wherein the guiding mechanism comprises stops and/or stop faces which are provided in the guiding mechanism, and which hold the cover in a top position of the cover.

10 Claims, 8 Drawing Sheets

U.S. PATENT DOCUMENTS

| | | | | |
|---|---|---|---|---|
| 4,966,561 | A * | 10/1990 | Norden | 439/620.34 |
| 5,406,449 | A * | 4/1995 | Hicks et al. | 361/616 |
| 5,559,662 | A * | 9/1996 | Happ et al. | 361/104 |
| 5,831,228 | A * | 11/1998 | Kuki et al. | 200/16 E |
| 5,833,484 | A * | 11/1998 | Post et al. | 439/352 |
| 5,842,560 | A * | 12/1998 | Kuki et al. | 200/43.05 |
| 5,847,338 | A * | 12/1998 | Kuki et al. | 200/17 R |
| 5,859,580 | A * | 1/1999 | Hashizawa et al. | 337/260 |
| 5,973,418 | A * | 10/1999 | Ciesielka et al. | 307/130 |
| 6,157,287 | A * | 12/2000 | Douglass et al. | 337/198 |
| 6,317,312 | B1 * | 11/2001 | Hashizawa et al. | 361/642 |
| 6,325,647 | B1 * | 12/2001 | May et al. | 439/157 |
| 6,333,846 | B1 * | 12/2001 | Hashizawa et al. | 361/649 |
| 6,366,449 | B1 * | 4/2002 | Hashizawa et al. | 361/642 |
| 6,407,656 | B1 * | 6/2002 | Konda et al. | 337/194 |
| 6,587,028 | B2 * | 7/2003 | Mollet et al. | 337/194 |
| 6,650,222 | B2 * | 11/2003 | Darr et al. | 337/187 |
| 6,717,505 | B1 * | 4/2004 | Bruchmann | 337/194 |
| 6,727,797 | B1 * | 4/2004 | Bruchmann | 337/210 |
| 6,736,655 | B2 * | 5/2004 | Martin et al. | 439/157 |
| 6,784,783 | B2 * | 8/2004 | Scoggin et al. | 337/194 |
| 6,853,289 | B2 * | 2/2005 | Scoggin | 337/194 |
| 6,997,725 | B2 * | 2/2006 | Stella et al. | 439/157 |
| 6,998,954 | B2 * | 2/2006 | Milanczak | 337/194 |
| 7,355,503 | B2 * | 4/2008 | Buettner | 337/211 |
| 7,474,194 | B2 * | 1/2009 | Darr et al. | 337/72 |
| 7,561,017 | B2 * | 7/2009 | Darr et al. | 337/79 |
| 7,750,789 | B2 * | 7/2010 | Titokis et al. | 337/194 |
| 2003/0199184 | A1 * | 10/2003 | Martin et al. | 439/157 |
| 2005/0098419 | A1 * | 5/2005 | Matsui et al. | 200/311 |
| 2008/0242150 | A1 * | 10/2008 | Chikamatsu et al. | 439/620.3 |
| 2009/0246992 | A1 * | 10/2009 | Martin | 439/157 |

FOREIGN PATENT DOCUMENTS

| | | | |
|---|---|---|---|
| DE | 976 772 | | 4/1964 |
| DE | 1 246 848 | | 8/1967 |
| DE | 37 41 743 | | 6/1989 |
| DE | 102007053535 | A1 * | 5/2009 |
| EP | 0 432 652 | A1 | 12/1990 |
| EP | 0 852 388 | A1 | 12/1997 |
| FR | 2877138 | A1 * | 4/2006 |

* cited by examiner

HOLDER FOR FUSES

The present application claims priority of German patent application Serial No. 102009017338.2, filed Apr. 14, 2009, the content of which is hereby incorporated by reference in its entirety.

BACKGROUND OF THE INVENTION

The invention relates to a holder for fuses, in particular for cylindrical fuses.

In the use of holders for fuses, it is necessary to check the fuses after a certain operating time or to exchange them when they have melted down.

SUMMARY OF THE INVENTION

The invention is based on the object of providing a holder for fuses that ensures, in particular, high operating safety and allows fuses to be easily exchanged, even when live.

According to the invention, this object is achieved by a holder for fuses, in particular for cylindrical fuses, with a housing which has an opening to a receiving shaft and in which contacts are provided for at least one fuse, with a cover, preferably in the form of a cover plate, which is adjustably arranged in the receiving shaft and a fuse holding device which is adjustably guided in the receiving shaft, wherein the cover plate has means which are engaged with guides formed on the housing and hold the cover plate at a predetermined position within the housing and set apart from the contacts.

The holder according to the invention has a cover, preferably in the form of a cover plate, which, together with the fuse holding device, is displaceably mounted in the receiving shaft. When the fuse holding device is removed, the cover plate is locked in a position remote from the bottom of the holder as soon as the fuse holding device is removed, as a result of which the contacts located therebelow are covered and it is impossible for the operator to access them using his fingers or the like. When the fuse holding device is inserted, the cover plate is displaced through the fuse holding device toward the bottom within the receiving shaft to the extent that the electrical contacts of the fuse located in the fuse holding device can be inserted into associated electrical contacts. In a preferred embodiment, the cover plate is biased by a spring device. The cover plate is also provided with means which fix the cover plate in a top position when the fuse holding device is removed, so the operator is unable to access the receiving shaft using his fingers.

The holder according to the invention for fuses is suitable, in particular, for the use of special, cylindrically configured fuses, in particular for photovoltaic installations having voltages of 1,200 V, for example. The holder has an opening to a receiving shaft within which a fuse holding device, which can be engaged with and disengaged from a cover, preferably in the form of a cover plate, is displaceably and removably arranged. The housing of the holder preferably consists of two housing shells within which the shaft for receiving the fuse holding device is defined. The fuse holding device is displaceable in relation to the receiving shaft in two mutually opposing directions with the aim of enabling the fuse holding device to be completely removed from the receiving shaft in order to exchange the fuse and to be reinserted into the receiving shaft once the fuse has been exchanged.

Displaceably mounted below the fuse holding device, within the receiving shaft, is a cover, preferably in the form of a cover plate, which in a preferred embodiment is coupled to the fuse holding device over a predefined path of movement and is uncoupled, when the fuse holding device is removed, at a specific position within the receiving shaft in relation to the fuse holding device and remains within the receiving shaft for covering the electrical contacts located in the housing, thus preventing an operator from feeling for the contacts using his fingers. When the fuse holding device is inserted, the cover is displaced toward the bottom of the receiving shaft. The cover plate is provided with means which hold the cover plate in a predefined position remote from the bottom of the receiving shaft when the fuse holding device is removed from the receiving shaft, thus covering the receiving shaft toward the electrical contacts located therebelow. When the fuse holding device is inserted, the cover plate is displaced downward in the receiving shaft, thus freeing up the electrical contacts for insertion of the fuse located in the fuse holding device.

In a preferred embodiment, provision is made for coupling devices to be provided between the cover plate and the fuse holding device in order to connect the fuse holding device to the cover plate so, when the fuse holding device is inserted from a specific path of movement, the fuse holding device is displaced, together with the cover plate, into the receiving shaft and, when the fuse holding device is removed, the cover plate is displaced, together with the fuse holding device, over a predefined path of movement within the receiving shaft toward the opening thereof up to a predefined position in which the fuse holding device and cover plate are separated in order that the cover plate remains in a "top" position, in which it is no longer possible to access the electrical contacts within the housing, and thus protects the operator's fingers in the desired manner.

BRIEF DESCRIPTION OF THE DRAWINGS

In order to clarify further features, preferred embodiments of the holder according to the invention will be described hereinafter with reference to the drawings, in which.

DERAILED DESCRIPTION OF ILLUSTRATIVE EMBODIMENTS

Figure 1:
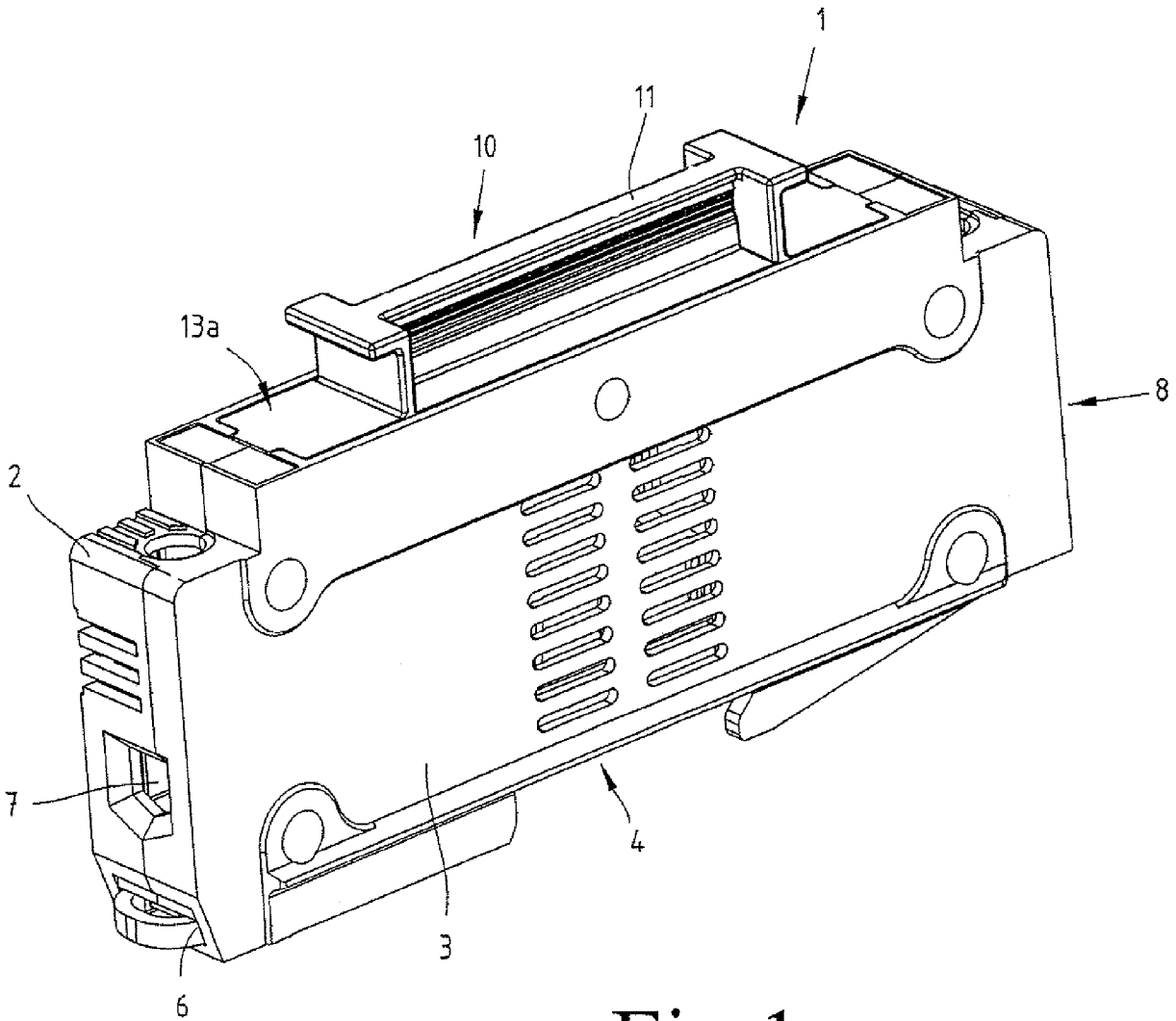
FIG. 1 is a perspective view of the holder according to the invention.

FIG. 1 is a perspective view of the holder 1 according to the invention for fuses. The holder 1 preferably consists of two housing halves 2, 3 which are connected to each other via screwing means (not shown in greater detail) or the like. Grooves 6 or the like, which are used for fastening in photovoltaic installations, are for example located at the lower face denoted by 4. Such measures are known per se and will not be commented on any further. Lateral entrances 7, 8, which are formed for electrically connecting the holder, are for example provided in the housing. The holder 1 has a fuse holding device 10 which is to be inserted in a receiving shaft to be described hereinafter and is provided with a handle 11 which can be used to displace the fuse holding device 10 in relation to the holder 1.

Figure 2:
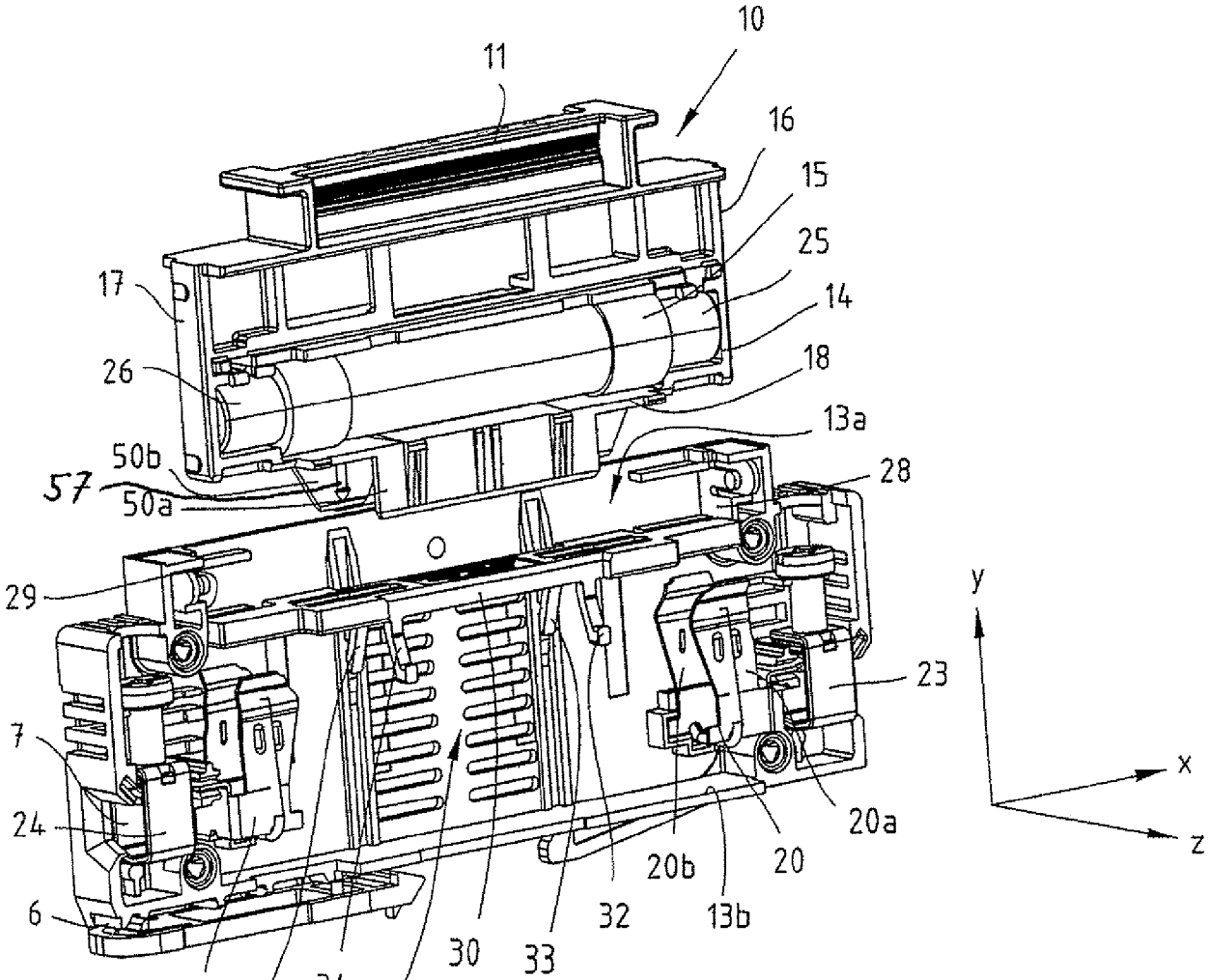
FIG. 2 and FIG. 3 are views of the holder, one half of the housing having been removed for the sake of clarity.

FIG. 2 illustrates a preferred embodiment of the holder 1 according to the invention, one half 3 of the shell having been omitted in order to be able to describe the principle of the holder according to the invention more clearly.

A receiving shaft 13, into which the fuse holding device 10 can be inserted, is located within the holder 1 consisting of the two housing shell halves 2, 3. The fuse holding device 10 has the function of a drawer and contains a chamber or a receiving slot 14 for receiving a substantially cylindrical fuse 15. The fuse holding device 10 is provided with lateral wall portions 16, 17 serving, on the one hand, as a guide within the holder 1 and, on the other hand, to laterally surround the fuse 15. In the illustrated embodiment, a receiving web 18, which constitutes a wall downwardly delimiting the fuse holding device 10, is formed at the lower face of the fuse holding device 10. An upper receiving web 19 upwardly delimits the space for receiving the fuse 15.

Figure 3:
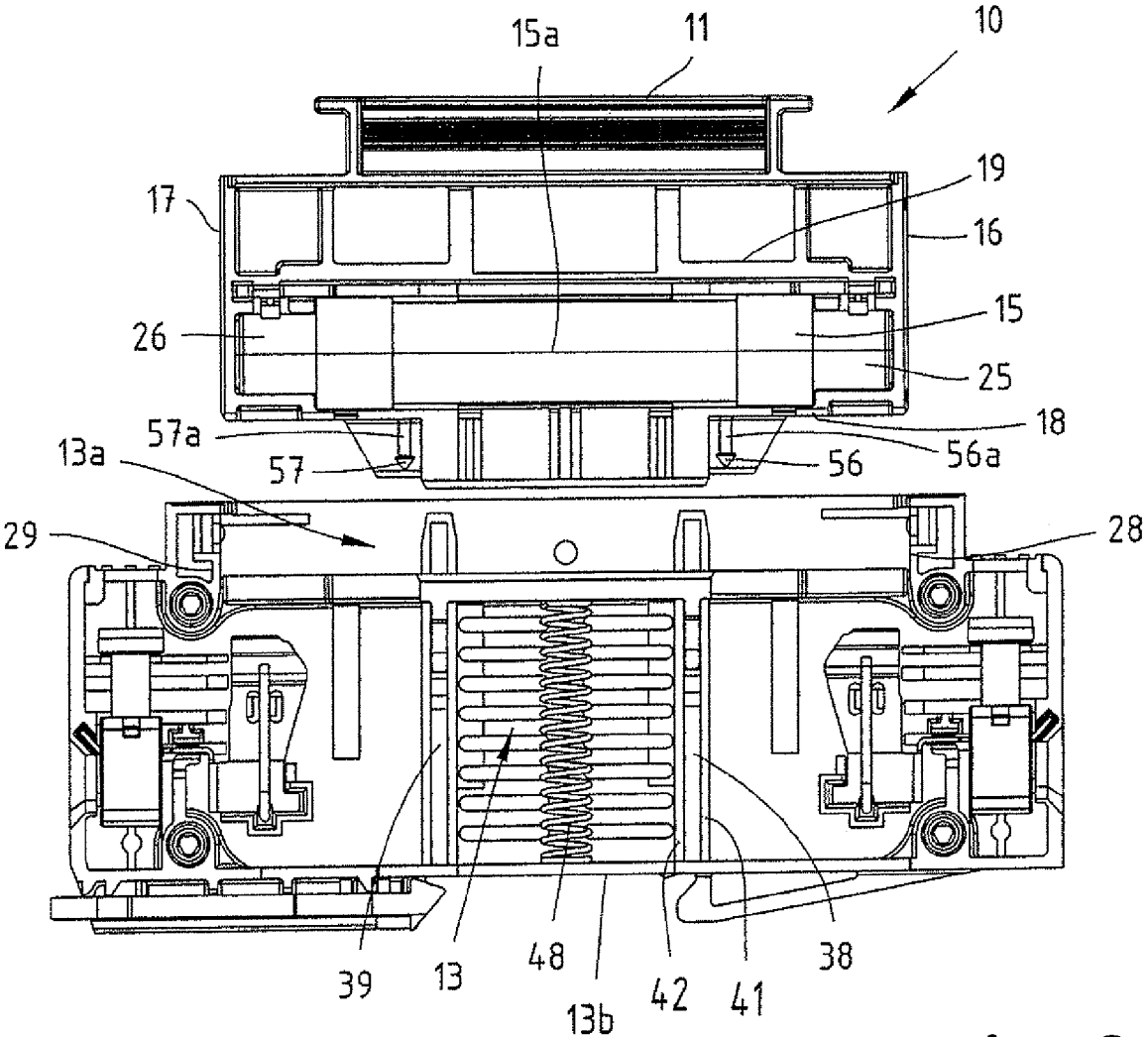
Figure 4:
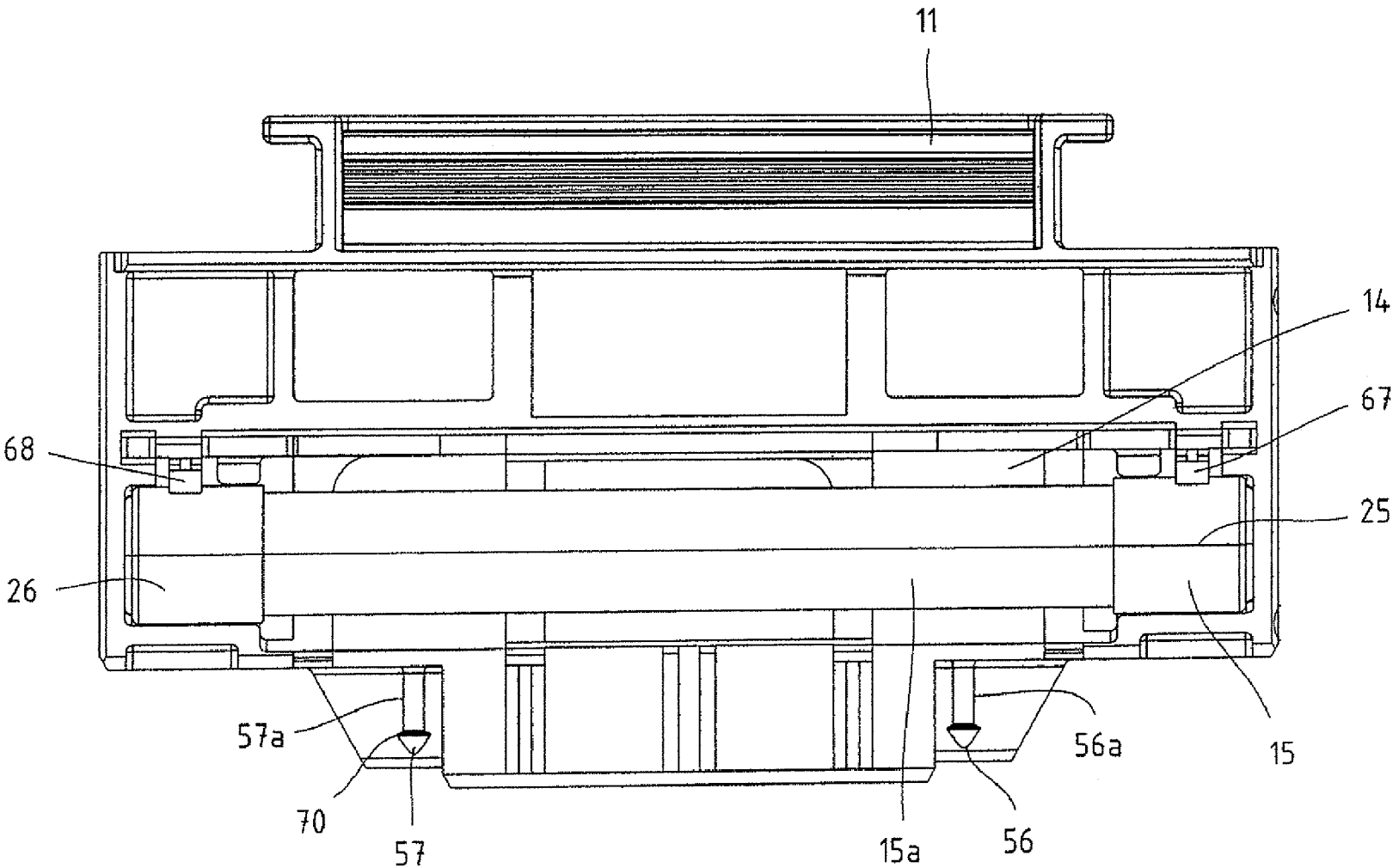
FIG. 4 is a view of a preferred embodiment of a fuse holding device.

Reference will now be made to FIGS. 3 and 4. FIG. 3 is a partial view of the holder according to the invention corresponding to FIG. 2. FIG. 4 is a detailed view of the fuse holding device 10.

As is particularly clear from FIGS. 2 and 3, electrical contacts 20, 21 are laterally located in the holder 1. FIG. 2 shows the coordinate system. The contacts 20, 21 each have contact tongues which are parallel to each other in the direction of the Y axis and set apart from each other in the direction of the Z axis, are denoted in relation to the contact 20 by 20*a*, 20*b* and are each connected to a respectively associated terminal 23, 24 for an electrical cable. The contacts 20, 21 are set apart from each other in such a way that the contacts denoted by 25, 26 of the fuse 15 are received as soon as the fuse holding device 10 is inserted into the receiving shaft 13 sufficiently far for the contacts 25, 26 of the fuse 15 to enter the intermediate space between the contact tongues 20*a*, 20*b* of the contacts 20, 21.

Furthermore, each housing shell 2, 3 is provided with a counter guide in the form of guide walls 28, 29 in order to form a guide in relation to the wall portions 16, 17 of the fuse holding device 10.

A cover, preferably in the form of a cover plate 30, is associated with the fuse holding device 10, both the fuse holding device 10 and the cover plate 30 being displaceable into and out of the receiving shaft 13 along the Y axis (FIG. 2). Nevertheless, the cover plate 30 cannot be slid right out of the receiving shaft 13, as will be described hereinafter, but is stopped by means which will be commented on below at a predefined, top position (FIG. 2) within the receiving shaft 13 when the fuse holding device 10 is withdrawn from the receiving shaft 13.

FIG. 2 and FIG. 3 show the state in which the fuse holding device 10 has been removed from the receiving shaft 13. In this state, the cover plate 30 is in a top end position in which the cover plate 30 remains and thus covers the contacts 20, 21 or prevents an operator from accessing the contacts 20, 21 using his fingers or the like in that the cover plate 30 is locked at a predefined distance above the contacts 20, 21. Means, which interact with guides or the like formed on the housing side, as will be described hereinafter in greater detail with reference to a preferred embodiment, are provided to hold the cover plate 30 in this position.

In the preferred embodiment illustrated in the figures, the cover plate 30 is provided with two pairs of laterally protruding feet 32, 33, 34, 35, and each pair of feet 32, 33 and 34, 35 respectively has the shape of an inverted V, the foot portions 32 to 35 being provided so as to protrude downward from the cover plate 30 and having a predefined resilience. A laterally angled foot portion is formed at the end of each foot 32 to 35, as may be seen more clearly from FIG. 5, FIG. 5 being a bottom view of the cover plate.

Figure 5:
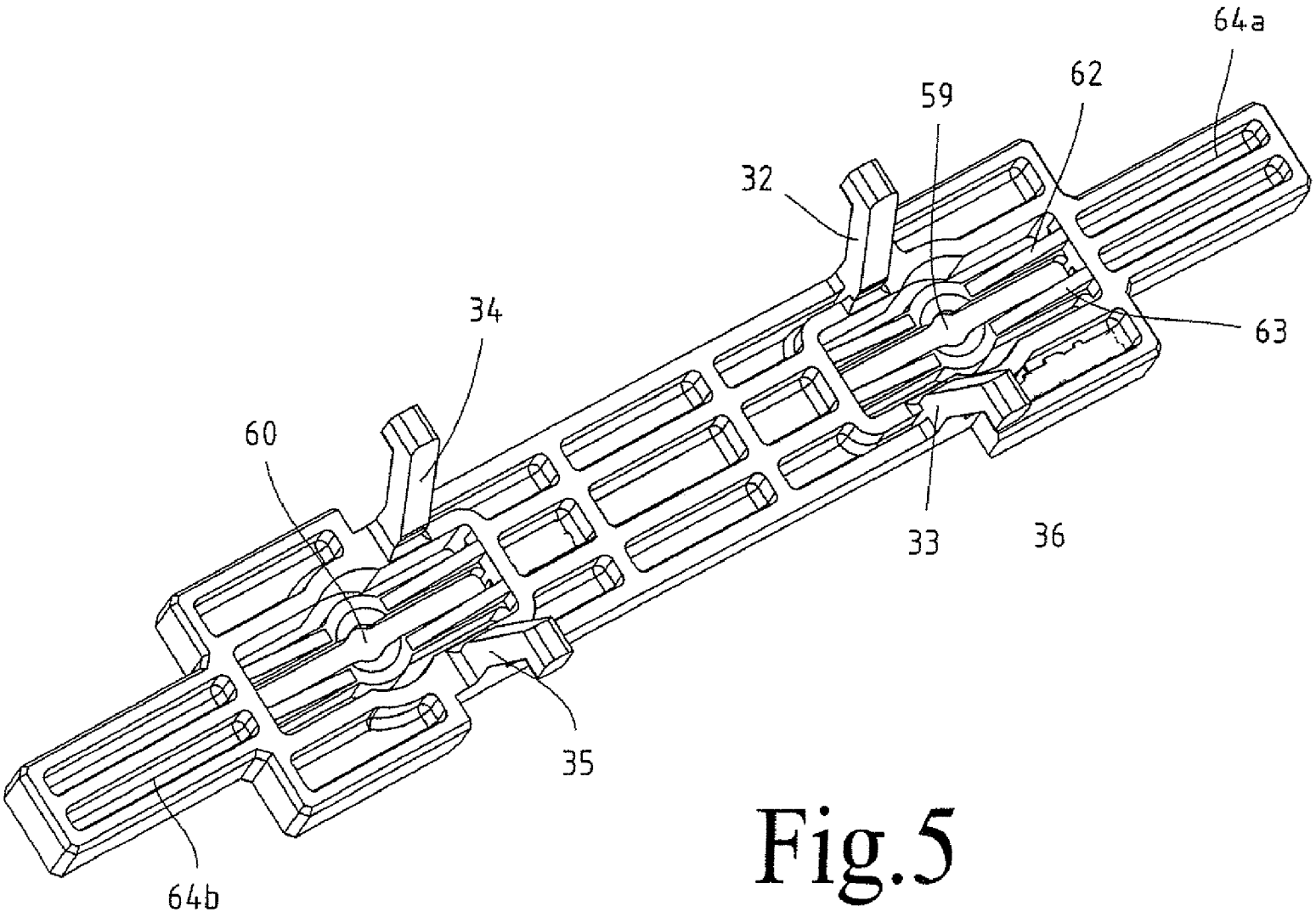
FIG. 5 is a bottom view of a cover.
Figure 7:
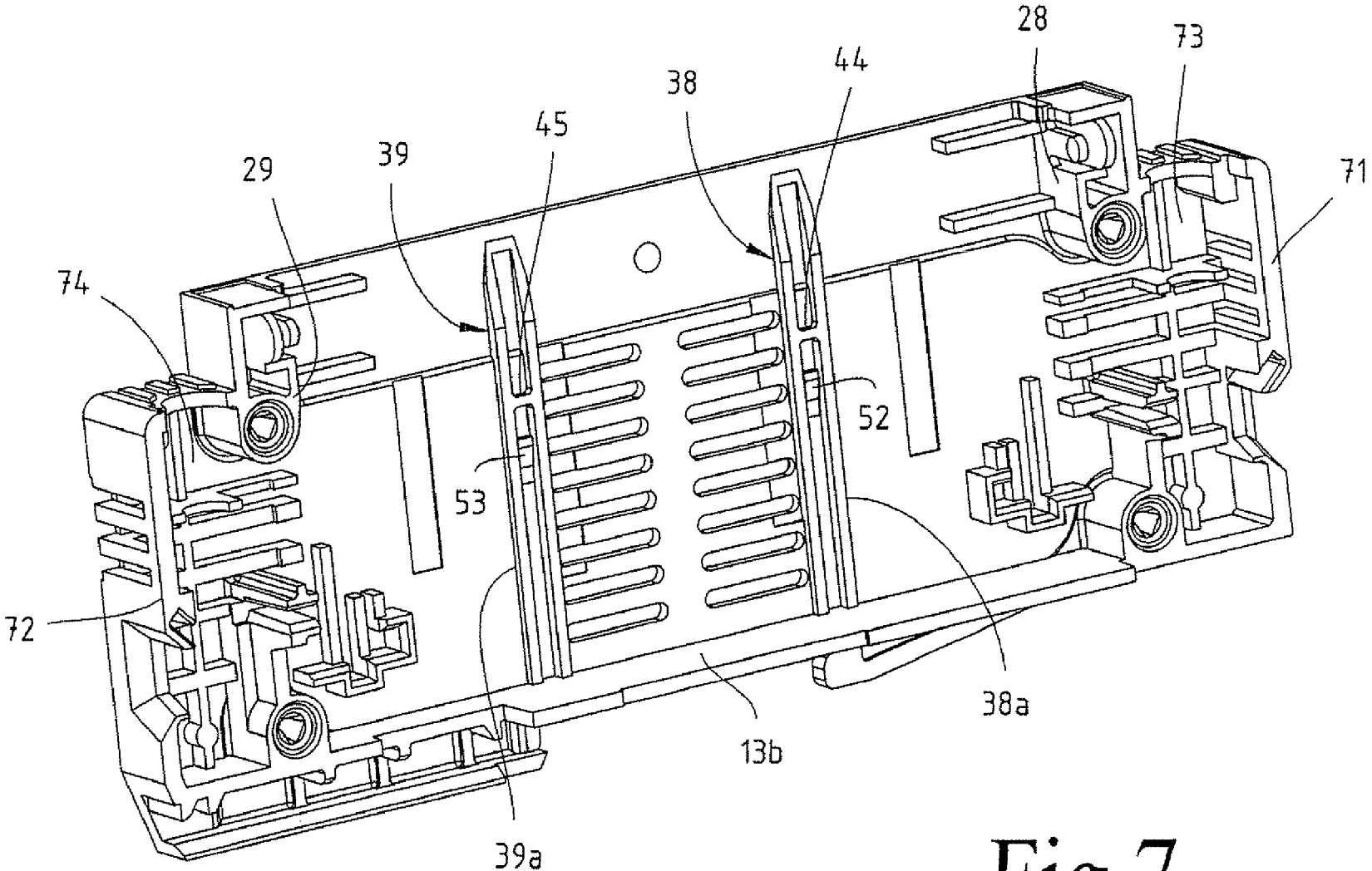
FIG. 7 is an inside view of one half of the housing in order to better illustrate the guides.

In FIG. 5 one of the foot portions is denoted by 36. These angled foot portions 36 are each engaged with guides 38, 39 (FIG. 3) which are, for example, each defined by mutually parallel webs at the inner wall face of the shell half 2, 3 that are denoted in relation to the guide 38 by 41, 42. The same is true of the other guides which are respectively formed on each housing shell 2, 3, opposing each other in the holder 1. Each pair of guides 38, 39 is set mutually apart and oriented in the Y-axis. Instead of webs 41, 42 of this type, it is also possible to provide other guide means, for example in the form of grooves, in the inwardly pointing wall of the housing shells 2, 3. What matters is that each foot portion 36 of the pair of feet 32, 33, 34, 35 slides along the guides 38, 39 when the cover plate 30 is displaced in the direction of the Y axis (FIG. 2). Stops or transverse ribs, which are shown in the perspective view of the housing shell 2 in FIG. 7, are formed in the guides 38, 39 to prevent further displacement of the cover plate 30, in the top position shown in FIG. 2, in the direction of the Y axis. The guides have a lower portion 38*a* and 39*a* within which the foot portions 36 of each foot 32 to 35 can slide until they abut the transverse ribs 44, 45 formed in each housing shell 2, 3; as a result, the cover plate 30 is stopped at the top position in question and, unlike the fuse holding device 10, is not displaced any further out of the receiving shaft 13. The foot portions 36 are formed accordingly so as to be unable to be displaced any further in the direction of the Y axis on striking the transverse ribs 44, 45. In the illustrated embodiment, the foot portions 36 jutting out on the feet 32 to 35 are at an angle of approx. 90° in relation to the guides 38, 39 of the housing shells 2, 3.

In a preferred embodiment, provision is made for the cover plate 30 to be biased by means of a spring device 48 (FIG. 3), for example one or more compression springs, into the top position shown in FIGS. 2 and 3 and thus to be moved jointly upward, as the fuse holding device 10 leaves the receiving shaft 13, in the direction of the Y axis in FIG. 2 until the position shown in FIGS. 2 and 3 is reached, in which the foot portions 36 abut the transverse ribs 44, 45 and prevent the cover plate 30 from moving upward any further on account of its engagement with the transverse ribs 44, 45.

Either latching teeth 52, 53, a latch or an inclined face having a flank which slopes upward slightly from the bottom of the shell half toward the opening 13*a* of the receiving shaft, is provided in the guides 38, 39, below the transverse ribs 44, 45 and set apart therefrom, as shown in FIG. 7. These latching teeth 52, 53 or the slightly upwardly sloping inclined face cause the foot portions 36 to enter the space between the transverse ribs 44, 45 and the inclined face 52, 53 when the cover plate 30 has reached the position shown in FIGS. 2 and 3, as a result of which the cover plate 30 is held in this position and remains in this position on account of the blockage by the inclined faces or teeth 52, 53. Furthermore, the slightly upwardly sloping inclined face 52, 53 allows the foot portions to easily ascend into the space between the transverse ribs 44, 45 and faces 52, 53, but prevents them from sliding off downward.

According to a preferred embodiment, in order to unlock the feet 32 to 35 which are locked in relation to the guides 38, 39 of both shell halves 2, 3, the fuse holding device 10 is provided with a control device 50 which is preferably formed by parallel tongues 50*a*, 50*b* which protrude downward on the web 18, the tongues having a width which is preferably at least as great as the distance between the feet 32, 33 and 34, 35 respectively. When the fuse holding device 10 is inserted, together with the fuse 15, into the receiving shaft 13 from the position shown in FIG. 2, the tongues 50*a*, 50*b* overlap the pairs of feet 32, 33 and 34, 35 respectively protruding laterally from the fuse holding device 10, as a result of which the pairs of feet are pressed together and the foot portions 36 at the end of each pair of feet on the guides 38, 39 are displaced in the direction of the centre of the housing, i.e. the respective pairs of feet are pressed together over a predefined minimum degree.

As a result of the pressing-together of the pairs of feet 32, 33 and 34, 35 respectively, the foot portions 36 become disengaged from the flanks of the inclined faces 52, 53, so it is possible for the cover plate 30 to descend toward the bottom 13*b* of the receiving shaft 13.

This embodiment is configured in such a way as to allow the fuse holding device 10 to be displaced over a predetermined degree in the direction of the receiving shaft 13, to the extent that the tongues 50*a*, 50*b* running parallel to the housing shells 2, 3 are moved over the pairs of feet 32, 33 and 34, 35 respectively, sufficiently far that the cover plate 30 enters the intermediate space of the tongues 50*a*, 50*b* and the foot portions 36 can then be displaced, by being pressed together, from their locked position.

In a preferred embodiment which can contain, but does not have to contain, a spring device 48, coupling means are provided to couple the cover plate 30 to the fuse holding device 10. A preferred embodiment provides between the fuse holding device 10 and the cover plate 13 coupling means which, according to a further embodiment, are formed at the lower face of the fuse holding device 10. In this embodiment, the coupling device is formed by latching pins 56, 57 which jut out on the receiving web 18 toward the bottom 13*b* of the housing and are at a predefined distance from each other that in this embodiment is greater than the length of the two tongues 50*a*, 50*b*, as is apparent from FIGS. 2 and 3. Each latching pin 56, 57 is attached to the downwardly pointing face of the receiving web 18 by means of a shaft 56*a* or 57*a*. In the illustrated embodiment, each latching pin 56, 57 has a tapered end, each latching pin 56, 57 having an external diameter which is larger than the diameter of the shaft 56*a*, 57*a* carrying it.

Figure 6:
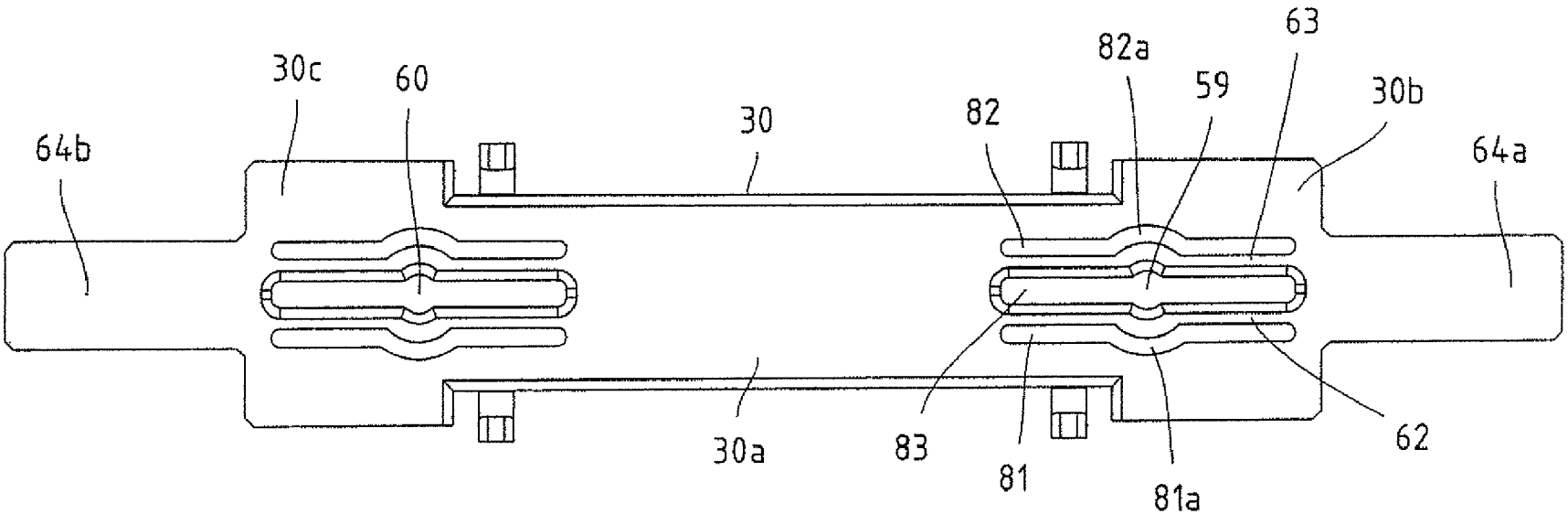
FIG. 6 is a top view of the cover.

Reference will now be made to FIGS. 5 and 6 which show the cover plate 30 from the lower face. The cover plate 30 is provided with two mutually set-apart openings 59, 60 which are preferably formed in a dome-like manner and in the illustrated embodiment are defined by two resilient webs 62, 63. The same applies to the opening 60, although the webs are not denoted individually in that case. Partially circular openings 59, 60, which are defined by two arcs of a circle formed in the webs 62, 63 and are preferably each configured in a both downwardly and upwardly conically tapered manner in order to allow the latching pins 56, 57 to be inserted and withdrawn in the desired manner, are located at the centre of the two resiliently articulated or resiliently formed webs 62, 63. The openings 59, 60 are adapted to the dimensions of the tapered ends of the latching pins 56, 57.

FIG. 6 is a plan view onto the cover plate 30, showing the conically extending configuration of the webs 62, 63 in the region of the openings 59, 60. The cover plate 30 has a central portion 30*a* which is less wide than the lateral portions 30*b* and 30*c*. Extended finger portions 64*a*, 64*b* adjoin the lateral portions 30*b*, 30*c* in the axial direction of the cover plate 30. The width of the finger portions 64*a*, 64*b* is selected so as to allow the finger portions to be displaced into the intermediate space between the contact tongues 20*a*, 20*b* when the intention is to contact the contact tongues 20*a*, 20*b* by lowering the fuse holding device 10. The length of the cover plate 30 corresponds to that of the opening 13*a* located at the upper face of the receiving shaft 13. The width of the portions 30*b*, 30*c* corresponds to the width of the receiving opening 13*a*. In this way, the opening 13*a* is covered almost completely when the cover plate 30 assumes its position shown in FIGS. 1 and 2. In order to allow the webs 62, 63 to be resilient, the webs are preferably provided on both sides with slots 81 to 83, the outer slots 81, 82 having a central portion 81*a*, 82*a* extending over a pitch circle, thus ensuring that the webs 62, 63 are flexible in the region of the respective opening 59 or 60.

Figure 8:
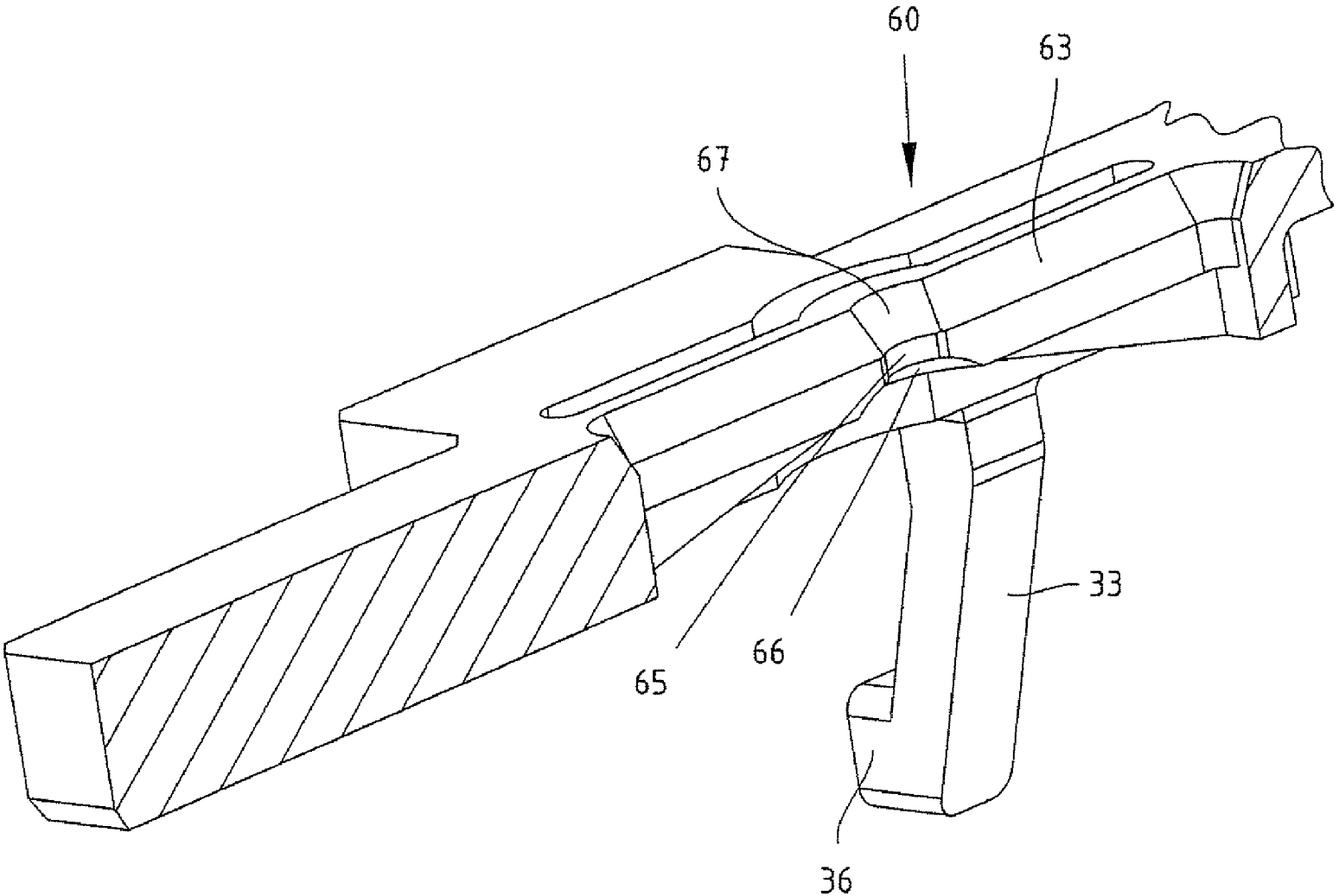
FIG. 8 is a partial sectional view through the cover.

FIG. 8 is a detailed view of the cover plate 30 in the region of the opening 60, the cover plate 30 being shown only partially and in cut-away form. With regard to the opening 59, the web 63 is provided with a face 65 which extends over a pitch circle and is upwardly and downwardly adjoined by a conically widening face 66, 67, thus forming a "dome" which ensures both insertion of the arrow-shaped tip of the latching pin 56, 57 and withdrawal of the latching pin.

The arrow-shaped tip of the latching pin 56, 57 is formed in the shape of a cone and adapted to the shape of the openings 59, 60 as described hereinbefore.

The mode of operation of the holder according to the invention will now be described.

In the state in which no fuse 15 is inserted into the holder 1, the cover plate 30 is in the "top" position which is shown in FIGS. 2 and 3 and in which it is locked and held via the foot portions 36 until the fuse holding device 10 is inserted with a fuse 15 into the receiving shaft 13 via the opening 13*a*. As soon as the tongues 50*a*, 50*b* of the fuse holding device 10 overlap the pairs of feet 32, 33 and 34, 35 respectively, sufficiently far that the foot portions 36 of each foot become disengaged from the teeth 52, 53 or disengaged from the flank of the obliquely tapered faces 52, 53, the fuse holding device 10 is displaced, together with the cover plate 30, toward the bottom denoted by 13*b* of the receiving shaft 13, to the extent that the fuse 15 is displaced between the contact tongues 20*a*, 20*b* of the contacts 20, 21 and electrical contact is established between the fuse 15 and contact 20, 21. In this state, the fuse holding device 10 is fully inserted into the holder 1, as is shown in FIG. 1, so now only the handle 11 protrudes from the holder 1. The procedure is reversed for removing the fuse holding device 10: the cover plate 30 either is entrained upward by the fuse holding device 10 and/or is gradually moved upward by a spring device 48 until the cover plate 30 reaches that position in which the foot portions 36 strike the transverse ribs 44, 45 and the cover plate 30 is prevented from moving further out of the receiving shaft 13.

When, during insertion of the fuse holding device 10, the cover plate 30 is displaced toward the bottom 13*b* of the receiving shaft 13, the bottom end position of the cover plate 30 is determined by the foot portions 36 which slide downward along the guides 38, 39 until they rest on the bottom 13*b* of the receiving shaft 13. Accordingly, the feet 32 to 35 are to be configured in such a way that the cover plate 30 comes to lie below the contacts 20, 21 when the holder is operative. The guides 38, 39 lie almost perpendicularly in relation to the bottom 13*b* of the receiving shaft 13 and are provided at a distance from each other along each shell half 2, 3 that corresponds to the spacing of the pairs of feet 32, 33 and 34, 35 respectively.

As may also be seen from the drawings, the contacts 20, 21 are located within the receiving shaft 13, whereas the terminals 23, 24 connected thereto are inserted and locked within the holder 1 with lateral outward displacement. The position of the contacts 20, 21 is particularly clear from FIGS. 2 and 3. For the purpose of accessing the terminals 23, 24, the holder is extended at the sides by protruding wall portions 71, 72, as shown in FIG. 7, and provided with an opening 73, 74 which can be accessed from above and through which the terminals 23, 24 can be acted on by means of a tool, in particular a screw driver.

In a preferred embodiment, in addition to the spring device 48, or even if the spring device 13 is not provided, the entrainment of the cover plate 30 as the fuse holding device 10 is withdrawn is ensured in that the latching pins 56, 57 have been inserted into the openings 59, 60 and the cover plate 30 is thus coupled to the fuse holding device 10. In this embodiment, as the fuse holding device 10 moves out of the receiving shaft 13, the coupling between the fuse holding device 10 and the cover plate 30 by means of the latching pins 56, 57 causes the cover plate 30 to be drawn upward until it reaches the position which is shown in FIGS. 1 and 2 and in which the foot portions 36 rest against the transverse ribs 44, 45 of the guides 38, 39. Further movement of the fuse holding device 10 causes disengagement of the latching pins 56, 57 as a result of the preferably conical configuration of the openings 59, 60, as described in relation to FIG. 7, after which the fuse holding device 10 can then be completely removed, while the cover plate 30 remains in the position shown in FIGS. 2 and 3 and thus covers the receiving shaft 13 from above as well as preventing the operator from feeling for the receiving shaft 13 using his fingers. The cover plate 30 remains in this position because the foot portions 36 within the guides 38, 39 abut against the latching teeth 52, 53 or flank of the inclined faces and, as a result, it is not readily possible for the cover plate 30 to be moved downward into the receiving shaft 13. The foot portions 36 are then released, during insertion of the fuse holding device 10, in the manner described hereinbefore in which the tongues 50*a*, 50*b*, after overlapping the pairs of feet 32, 33 and 34, 35 respectively, press the feet together, thus allowing the foot portions 36 to be displaced over the teeth or inclined face 52, 53.

During insertion of the fuse holding device 10 and also during withdrawal thereof, the fuse holding device 10 and cover plate 30 are at the same time displaced over a predefined path of movement, as described hereinbefore.

In the illustrated embodiment, the connecting of the fuse holding device 10 to the cover plate 30 is facilitated in that the webs 62, 63 are in a certain manner flexible, so a somewhat higher force has to be applied only briefly as the latching pins 56, 57 are passed through the openings 59, 60 or as the latching pins 56, 57 are withdrawn from the openings 59, 60 and at the same time violent removal of the cover plate 30 from the receiving shaft 13 is prevented during withdrawal of the fuse holding device 10.

The use of a spring device 48 is optional and not absolutely essential.

The guides 38, 39 formed on the inner face of both housing shells 2, 3 and provided symmetrically to each other. Both the housing shells 2, 3 and the fuse holding device 10 and the cover plate 30 are preferably made of an insulating material, preferably plastics material.

The configuration described hereinbefore of the holder 1 thus allows, before the fuse holder 10 is inserted, the opening 13*a* in the receiving shaft 13 to be secured by the cover plate 30, thereby ensuring that the operators fingers cannot touch the contacts 20, 21, and the cover plate 30 subsequently to be lowered into the receiving shaft 13 during insertion of the fuse holding device 10 while ensuring, conversely, as the fuse holding device 10 is withdrawn, that the cover plate 30 is also drawn back up into its position preventing access to the contacts 20, 21 in order to remain in the position in question until the fuse holding device 10 is reinserted into the receiving shaft 13.

According to FIG. 4, the fuse holding device 10 is designed so as to allow different cylindrical fuses 15 to be inserted. The different fuses are shown in FIGS. 3 and 4. The fuse 15 according to FIG. 3 has contacts 25, 26, the diameter of which is smaller than the central portion denoted by 15*a* of the fuse 15, whereas the fuse 15 according to FIG. 4 has an almost uniform diameter, i.e. the diameter of the central portion 15*a* also corresponds roughly to the diameter of the contacts 25, 26.

In relation to the latching pins 56, 57, it may be seen from FIG. 4 is that each latching pin 56, 57 has an annular portion 70, the external diameter of which is larger than the shaft 56*a*, 57*a*, and that from the annular portion, both toward the tip and toward the shaft 56*a* or 57*a*, a slightly bevelled or cone-shaped face is provided that allows easy insertion or withdrawal of the latching pins 56, 57 in relation to the openings 59, 60.

The portions 30*b* and 30*c* of the cover plate 30 are formed by protrusions which overall define a width corresponding to the width of the receiving shaft 13.

The holder according to the invention allows fuses to be exchanged in 1,200 V photovoltaic installations, for example, with high operating safety even when live, as access to the stationary electrical contacts associated with the fuse is effectively prevented by a cover plate during removal of the fuse holding device together with the fuse.

The invention claimed is:

1. A holder for receiving fuses, in particular for receiving cylindrical fuses, the holder comprising:

a housing in which a guiding mechanism is provided;

a receiving shaft with an opening to the receiving shaft, the receiving shaft containing contacts which are provided for contacting at least one fuse inserted into the receiving shaft;

a cover which is adjustably arranged in the receiving shaft;

a fuse holding device which is adjustably guided in the receiving shaft, wherein the cover is provided with a unit which is engageable with the guiding mechanism of the housing and which functions to hold the cover at a predetermined position within the housing and set apart from the contacts;

a spring device for biasing the cover;

a coupling device for detachably coupling the cover to the fuse holding device, wherein the cover has openings for receiving the coupling device, wherein the unit of the cover is formed by feet wherein each foot has foot portions at an end of each foot being angled relative thereto wherein the feet protrude laterally from the cover and are engageable with the guides in the housing, and wherein the guiding mechanism comprises stops and/or stop faces which are provided in the guiding mechanism and diagonally relative thereto, and which, by engagement of the foot portions with the stops and/or stop faces in the guiding mechanism, prevent a downward displacement of the cover along the guiding mechanism.

2. The holder of claim 1, wherein the cover has the form of a plate.

3. The holder of claim 1, wherein the coupling device is provided on the fuse holding device.

4. The holder of claim 1, wherein the coupling device is formed by latching pins which are engageable with the openings of the cover.

5. The holder of claim 1, wherein the openings of the cover are defined by resilient webs.

6. The holder of claim 1, wherein the contacts are provided with contact tongues and the cover comprises finger portions, wherein the width of the finger portions is less than the distance between the contact tongues.

7. The holder of claim 1, wherein the coupling device is formed by latching pins which are engageable with the openings of the cover, and wherein the latching pins are provided on the fuse holding device.

8. The holder of claim 1, wherein the coupling device is formed by latching pins which are engageable with the openings of the cover, wherein the latching pins are provided on the fuse holding device, wherein the latching pins have an annular portion from which the latching pin tapers, and wherein the latching pin contains a face and a shaft, the face is bevelling from the annular portion toward the shaft, the shaft protruding from the fuse holding device.

9. The holder of claim 1, wherein the openings of the cover are defined by partially circular and/or conically tapered web portions.

10. The holder of claim 1, wherein the fuse holding device is provided with a control device for adjusting the unit of the cover for locking the cover in relation to the housing.

* * * * *